US010094184B2

(12) United States Patent
Cox

(10) Patent No.: US 10,094,184 B2
(45) **Date of Patent: *Oct. 9, 2018**

(54) CRANELESS ELEVATABLE MGS VESSEL AND SWIVEL JOINT U-TUBE MUD LINE AND METHOD OF INSTALLATION

(71) Applicant: Camaron M. Cox, Houston, TX (US)

(72) Inventor: Camaron M. Cox, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/943,766

(22) Filed: Apr. 3, 2018

(65) Prior Publication Data

US 2018/0223611 A1 Aug. 9, 2018

Related U.S. Application Data

(63) Continuation-in-part of application No. 15/205,978, filed on Jul. 8, 2016, now Pat. No. 9,962,630.

(60) Provisional application No. 62/190,033, filed on Jul. 8, 2015.

(51) Int. Cl.

| | |
|---|---|
| ***B01D 19/00*** | (2006.01) |
| ***E21B 21/06*** | (2006.01) |
| ***E21B 21/01*** | (2006.01) |
| ***B66F 11/00*** | (2006.01) |
| ***E21B 21/02*** | (2006.01) |

(52) U.S. Cl.

CPC ..... *E21B 21/067* (2013.01); *B66F 11/00* (2013.01); *E21B 21/01* (2013.01); *E21B 21/02* (2013.01); *B66F 2700/05* (2013.01)

(58) Field of Classification Search

None

See application file for complete search history.

(56) References Cited

U.S. PATENT DOCUMENTS

| | | | | |
|---|---|---|---|---|
| 4,474,254 | A * | 10/1984 | Etter | E21B 21/06 175/206 |
| 4,981,319 | A * | 1/1991 | Gerzeny | B60J 7/165 296/165 |
| 8,202,336 | B1 * | 6/2012 | Moe | E21B 21/063 55/315 |
| 2011/0114389 | A1 * | 5/2011 | Mathena | E21B 21/067 175/66 |

* cited by examiner

*Primary Examiner* — Duane Smith
*Assistant Examiner* — Phillip Y Shao
(74) *Attorney, Agent, or Firm* — David B. Dickinson

(57) ABSTRACT

A craneless elevatable MGS vessel and U-tube assembly can be delivered on a winch truck to a drilling site and assembled in a far shorter time and without the need of having a crane and crane operator attend to the movement and placement of the MGS vessel and attached U-tube mud lines to a mud handling system in a drilling rig. The MGS vessel of the present application can be a standard type of MGS vessel well known in the industry. By fabricating this MGS vessel with attached and moveable U-tube connectors for the mud line, the system can be moved and assembled at the drill site without crane intervention. Moreover, the ability to raise the MGS vessel, after placement in its vertical position, permits ready attachment to multiple diverse drilling rig configurations.

4 Claims, 6 Drawing Sheets

CRANELESS ELEVATABLE MGS VESSEL AND SWIVEL JOINT U-TUBE MUD LINE AND METHOD OF INSTALLATION

CROSS REFERENCE TO RELATED APPLICATIONS

This is a continuation in part of application Ser. No. 15/205,978, filed Jul. 8, 2016.

FIELD OF INVENTION

The present invention relates to a mud gas separator (MGS) vessel for connection to a high pressure output from a drilling operation; more specifically, to a mud gas separator connection allowing craneless operation of the MGS, often called a gas-buster, from a support base frame without requiring the use of a crane to move the MGS vessel or the U-tube mud line to a mud handling system on a drilling rig operation, thereby allowing fast and efficient connection and disconnection of the MGS between the high pressure input lines and the shale shaker and mud pits into which the degassed mud is returned.

BACKGROUND OF INVENTION

A typical MGS vessel is a pressure vessel allowing an input of a large volume of drilling fluid comprised of mud and entrained gas, encountered in a high pressure situation commonly referred to as a "kick," resulting when the annular hydrostatic pressure in a well falls below the pressure experienced in the well from the down hole section of the well. The high pressure gas and mud mixture is directed to the surface and pressure is relieved through an initial set of fixtures or chokes, then the mud/gas mixture is directed to the MGS vessel where the mud flows over a series of baffles on the interior of the vessel allowing gas to be released and the mud to be collected in the bottom to be returned to the shell shaker then to the mud pit. Gas is vented off the top of the MGS vessel where is can be captured or flared as required by the volume and quality of the gas experienced. The technology for this type of MGS vessel is old and well known in the art.

The use of the MGS vessels and U-tube mud lines incapable of vertical movement impedes successful rapid set up and completion of drill rig since each portion needs a crane to grab and set the MGS vessel adjacent the shale shaker and mud pit on a modern drill rig and then to move an attachable U-tube line to the MGS vessel when positioned. The present invention relates to an apparatus allowing a U-tube line to be shipped with the MGS vessel then be moved into alignment and connection with a mud handling system (comprised of both the connection to the shale shaker and the mud pit) by hammer unions and pipe swivel joints utilizing self-contained hydraulic power located on the support base frame with the MGS vessel and U-tube mud line in a manner heretofore unseen by applicant. The hydraulic lift cylinders attached to the MGS vessel and to the U-tube mud line accomplishes all required movement.

Each manufacturer of drilling equipment places the shale shaker and related equipment at different positions on the drilling rig and, more significantly, at a variety of elevations off the ground level. In order to properly connect the MGS vessel to the shale shaker output, the MGS vessel must be placed within a convenient level of elevation relative to the shale shaker equipment.

This unique adjustable mud outlet line delivery system can be adjusted to provide a liquid seal without the need of further crane operation to move the U-tube mud line for connection to the MGS vessel and the mud handling lines at the mud pit.

BRIEF SUMMARY OF INVENTION

A craneless elevatable MGS vessel is comprised of a MGS vessel mounted on a support base frame providing a swivel bed supporting the vessel; hydraulic means for raising the vessel from its shipping position to its operating position and elevating the MGS vessel to a level consonant with the position of the shale shaker source of its input lines; a gas vent line extending from its distal end; a U-joint connecting the sump line of the vessel interposed between the sump line and mud pit line providing a swivel joint at an upper end of the U-joint and a second swivel joint at a lower end of the U-joint, spaced apart by a spacer or brace and supported by a hydraulic cylinder connecting the upper extension of the U-joint to the adjacent extended U-joint member for moving the U-joint in independent directions to connect the MGS vessel to the mud handling system of the drilling rig.

The craneless elevatable MGS vessel can be installed by moving the MGS vessel on its support base frame to the shaker side or trip tank of the mud system where the U-tube can be connected to the flow line, hydraulically raising the MGS vessel from its transportation horizontal position into a vertical position, and thereafter raising the MGS vessel in its vertical position to accommodate the connection lines to the shale shaker's choke line and top vent line. The choke line and top vent lines are then connected to the MGS vessel. The U-tube mud line is hydraulically moved to connect with the mud handling system of the drilling rig, typically to the shale shaker line, then to the mud pit line.

DETAILED DESCRIPTION OF AN EMBODIMENT OF THE INVENTION

Figure 1:
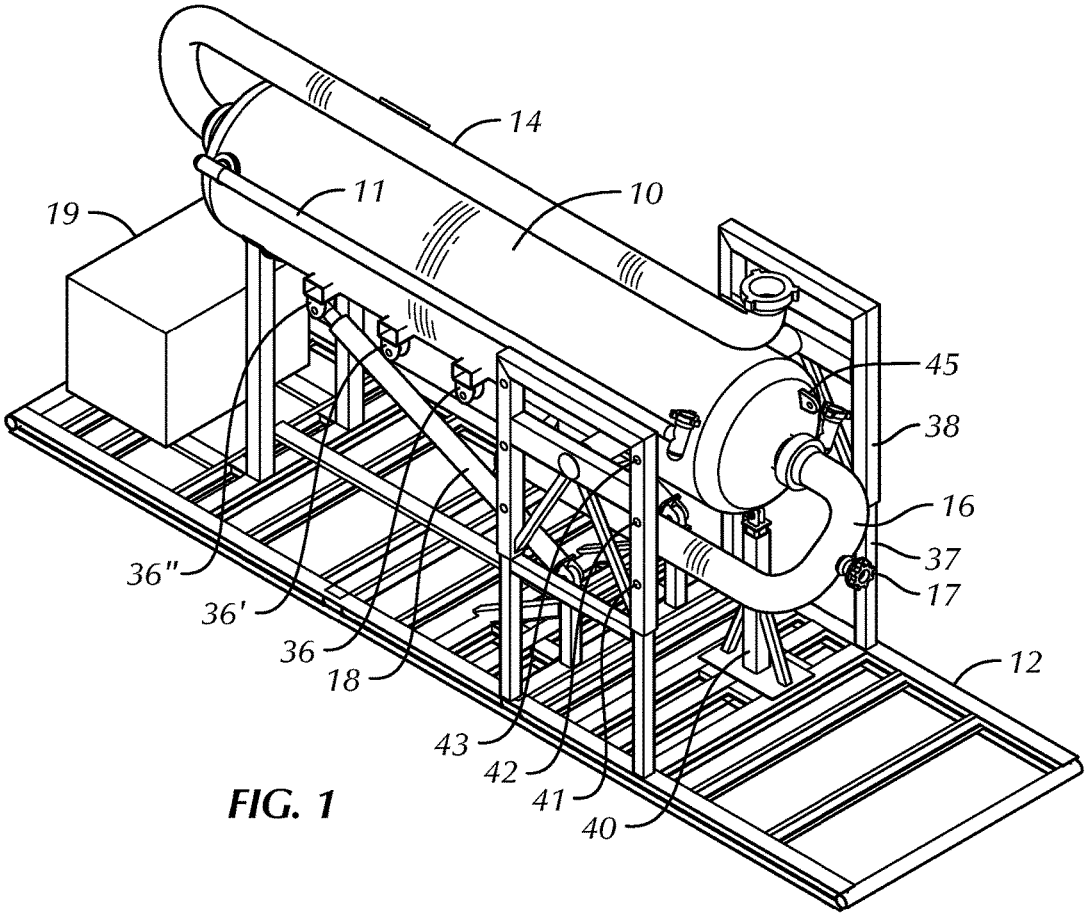
FIG. 1 is a three-dimensional perspective view of the MGS vessel in its horizontal or transport mode.

FIG. 1 is a perspective view of the MGS vessel 10 with a craneless U-tube assembly attached to the vessel mounted on support base frame 12 deliverable to a drilling rig site. Gas vent line 14 is attached to the top of the MGS vessel in a manner well known in the art and is designed to carry off as much of the entrained gas carried up the annulus by the drilling mud. Mud line 16 is attached to the bottom of the MGS vessel 10 again in a manner well known in the art. Double-acting hydraulic lift means 18 are installed at the fabrication shop and are connected to a source of hydraulic power contained in support base frame-mounted hydraulic pressure source 19. The mud line joint 16 could also contain a jet nozzle (ball valve) to allow rapid release of gas which may have reached the mud outlet to prevent it from being sent to the mud pit and a standard drain valve 17 to drain the remaining portion of mud from the tank upon completion of the circulation.

Fixed support frames 37 are attached on both sides of the MGS vessel 10 to the support base frame and support a sliding support frames 38, which contains the swivel mount for the MGS vessel 10. Both the fixed support frames 37 and the sliding support frames 38 provide holes, 41, 42, and 43 allowing the frames to connected by pins extending through the fixed support frames 37 and the sliding support frames 38.

Figure 2:
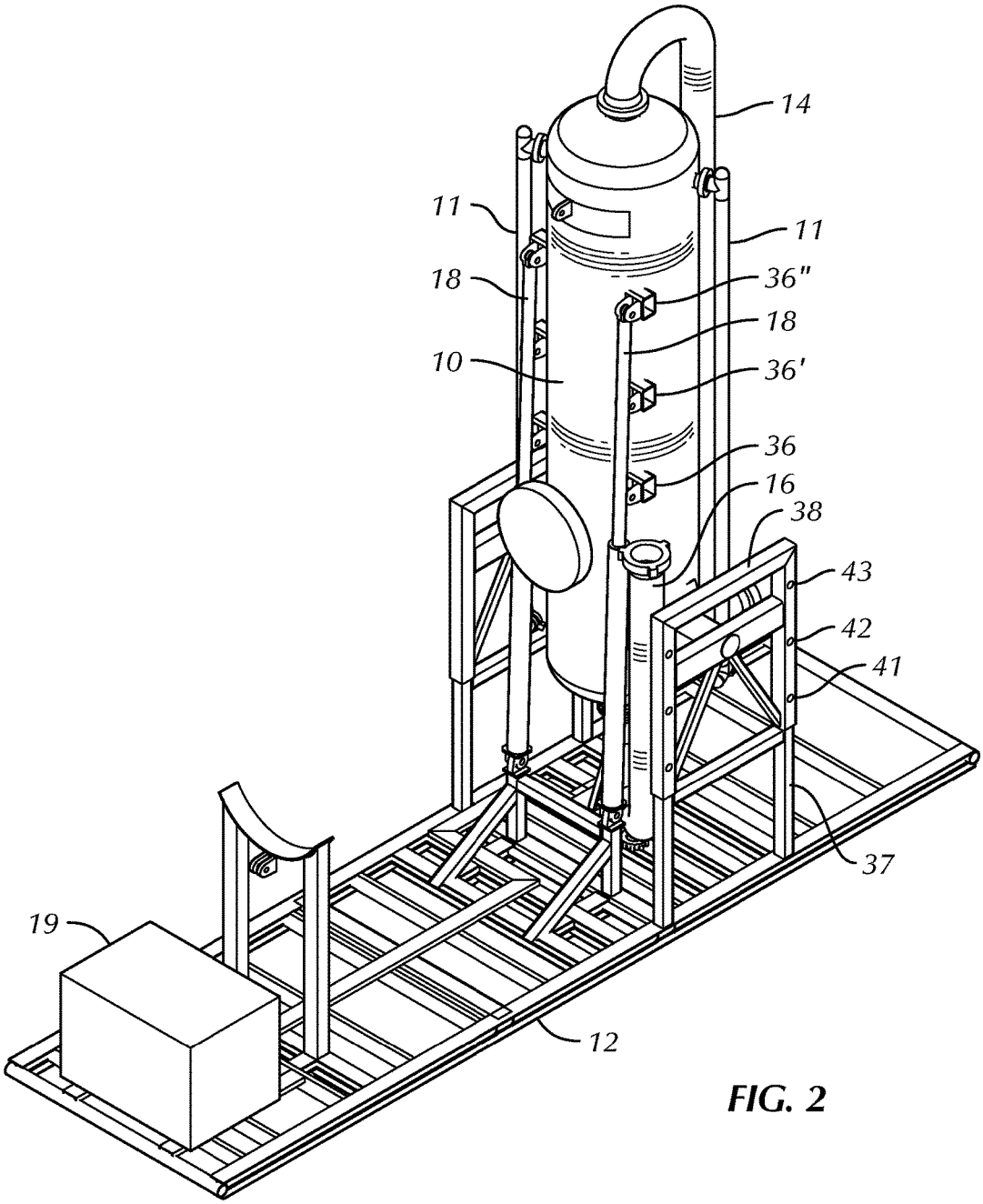
FIG. 2 is a three-dimensional perspective view of the MGS vessel in the vertical or connection mode.

FIG. 2 is a perspective view of the MGS vessel 10 after delivery and before completion of the connection to the mud pit lines (not shown). High pressure (and often multiple) inlet lines 11 take the mud/gas mixture from the choke manifold and introduce the mixture into the uppermost portion of the MGS vessel 10 allowing the mud/gas mixture to traverse the baffle plates in the MGS vessel to thereby release the entrained gas for vent through gas vent line 14 all in a manner well known in this art. In this view, the double-acting hydraulic pistons 18 are attached to the highest lifting lug 36".

Figure 3A:
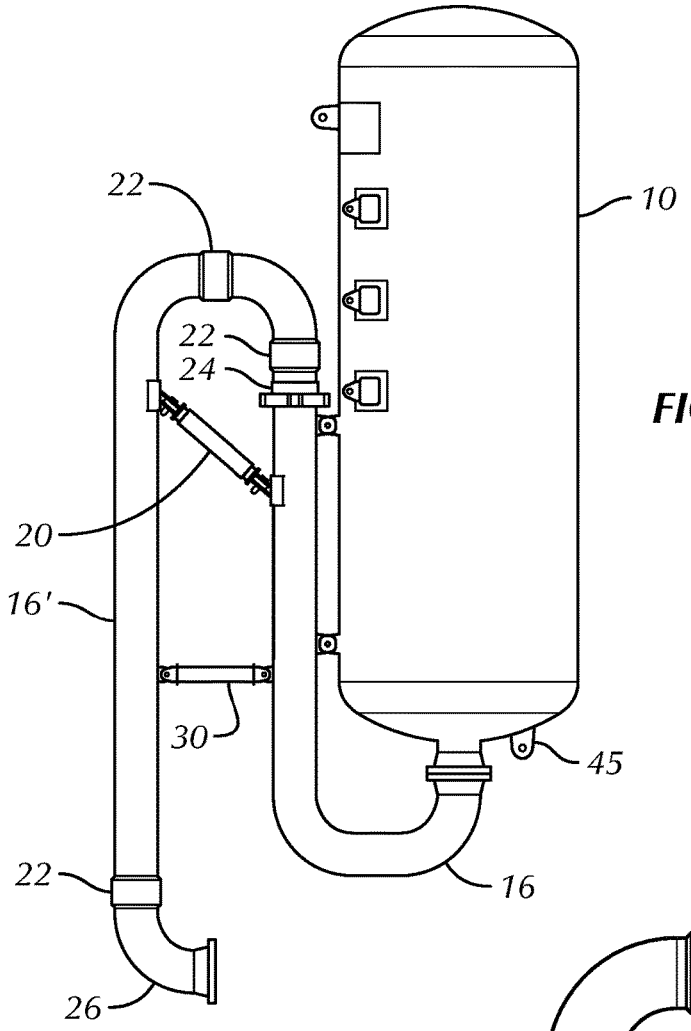
FIG. 3A is a detailed view of the U-joint connection on the mud outlet side of the MGS vessel.

FIG. 3A is a detailed view of the MGS vessel 10 connected to a mud outlet line 16 to which is attached swivel joints 22 allowing the MGS vessel mud outlet line to be connected to the mud recirculation pit on the drilling rig. Spacer 30 is disconnected from the U-joint assembly after shipment to the drilling rig site. The upper portion of the mud line 16' is then rotated by hydraulic piston 20 to its operational position to connect to the mud recirculation pit.

During shipment of the MGS vessel and attached U-joint, brace or spacer 30 holds the opposing sections 16, 16' of the U-tube in fixed position, permitting shipment without damage to either the vessel or the U-tube assembly. For installation, this brace or spacer 30 is removed or disconnected. The upper portion of U-joint 16 is fitted with a sleeve 24 connected to a hydraulic cylinder 20 capable of swiveling and lifting the upper portion of the U-tube joint 16' closer to the mud pit lines. Pipe swivels 22 are located between the lower portion of the U-tube joint 16 and the upper portion 16', and at the upper end of U-tube joint 16', thereby allowing rapid alignment with the mud system lines with the U-tube assembly. The U-joint mud line typically weighs between 350 and 575 lbs., and cannot be manipulated without the use of the crane or—as described herein—the hydraulic lift arm 20 driven by the hydraulics from the delivery support base frame. The swivel joint 22 connected to elbow 26 at the upper end of the U-tube assembly 16' allows rapid alignment and set-up of the MGS vessel at the drilling rig site. Hammer union 28 locks the sleeve assembly 24 in place.

Figure 3B:
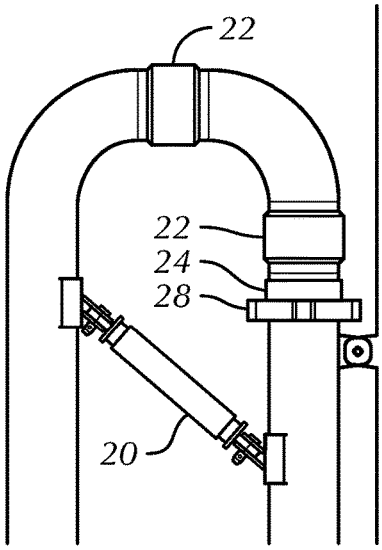
FIG. 3B is an expanded detailed view of the U-joint connection on the mud outlet side of the MGS vessel detailing the hydraulic raising cylinder and the slip joints which allow movement of the connection upon installation.

FIG. 3B is a bubbled view of the elements of the U-tube connection claimed as unique by applicant. All prior art MGS vessels known to applicant required a crane to move the MGS to either the rig floor or onto a stand located adjacent the rig floor. The present invention relates to a unique U-tube assembly, which allows the U-tube to be affixed to the MGS vessel during transportation to the drilling rig located, then installed on the drilling rig without the necessity for lifting the vessel. The combination of the swivel unions 22 with the sleeve 24 and hammer union 28 shown in this view without its other elements previously described provides a mud outlet joint 16 as shown in FIG. 3A from a bottom of the vessel 10 that can be quickly locked into place and operational, saving countless hours in set-up and therefore considerable money to the driller.

Figure 4:
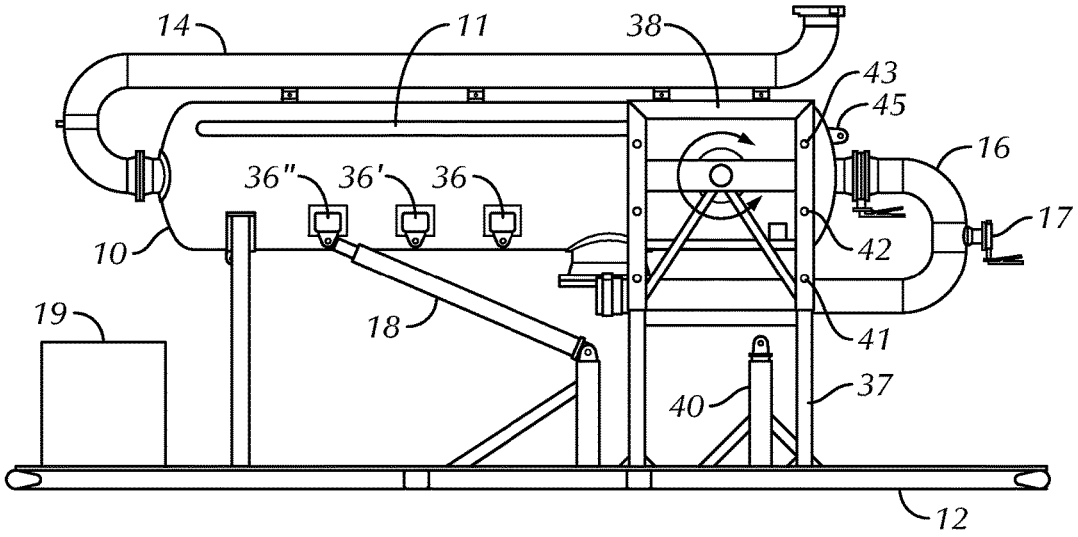
FIG. 4 is a side view of MGS vessel in its transportation mode prior to set up showing the multiplicity of lifting lugs attached to the exterior surface of the vessel with the hydraulic arm attached to the topmost lifting lug.

FIG. 4 shows the MGS vessel 10 in shipment mode with the hydraulic lifting means 18 attached to the topmost lifting lug 32 permitting up setup the MGS vessel to be raised to the lowest height on the support structures 37 and 38. Similarly, the operator can attach the double-acting hydraulic lifting means 18 to lifting lug 36 to raise the MGS vessel 10 to a higher position in relation to the rig floor, the shale shaker and related equipment.

During the raising the MGS vessel 10 from the horizontal position, the double-acting hydraulic lifting means 18 keeps MGS vessel 10 supported by the upper most lifting lug 36", which keeps the MGS vessel supported during the lifting procedure. After placement in the vertical position, the vessel is detachably connected to the support post 40 which is attached to a connection lug 45 on the bottom cap of the MGS vessel 10 (not shown in the view of FIGS. 1 and 2, but shown on FIG. 3A. After attachment of the support post 40, the MGS vessel 10 can be disconnected from the double-acting hydraulic lifting means 18 at attachment lug 36" and reattached to either the intermediate attachment lug 36' or the lowest attachment lug 36, thus allowing the MGS vessel 10 to be moved to variable height within the support structures 37 and 38. The support frames can then be pinned at 41, 42, or 43 to maintain the MGS vessel at a variable height to allow the U-tube upper arm 16' with its right elbow member 26 to be connected to the shaker possum belly on the shaker mud tank (not shown in this view). The possum belly is a metal container at the head of the shale shaker to receive and slow the flow of drilling fluid into the shale shaker and is connected to the end of the flow line coming from the return line on the drilling rig.

Figure 5:
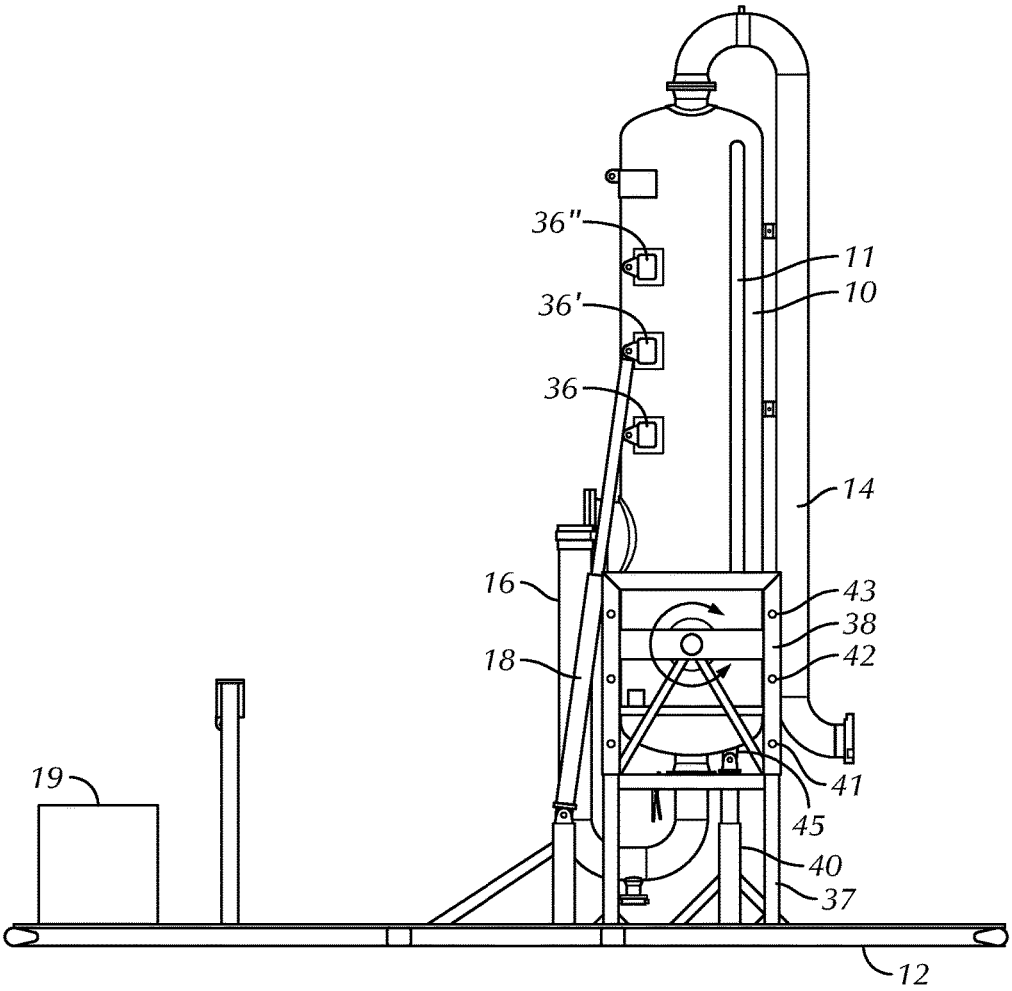
FIG. 5 is a side view of the MGS vessel in its operation mode set up with the hydraulic arm attached to the lowermost lifting lug.

FIG. 5 shows the MGS vessel 10 with the hydraulic lift arms 18 attached to the intermediate support lug 36' and the support arm 40 attached at lug 45 on a cap end of the MGS vessel 10

Figure 6:
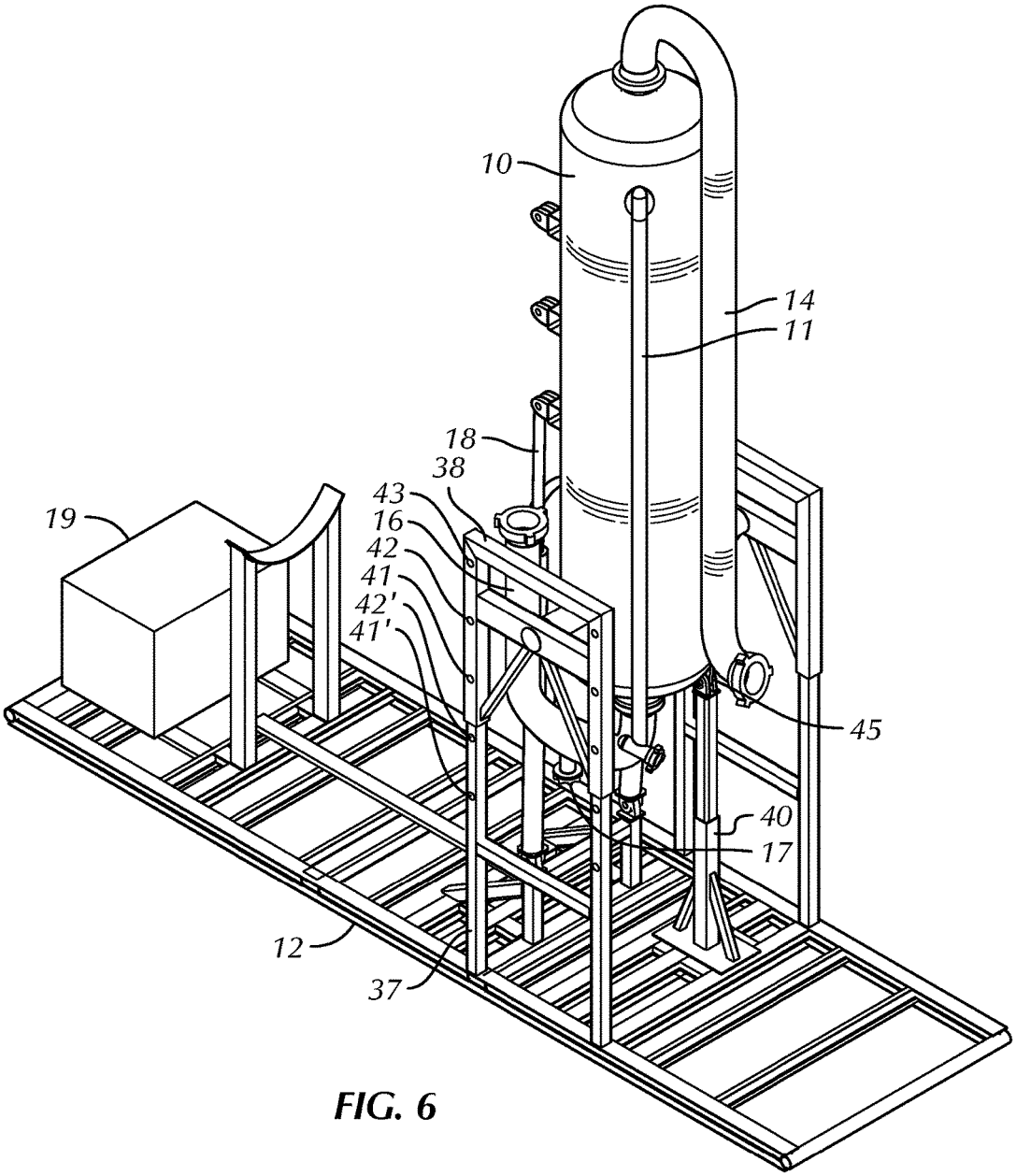
FIG. 6 is an elevation view of the MGS vessel in operation mode raised to a level to accommodate the attachment of lines from the drilling rig.

As shown in FIG. 6, the hydraulic lift arms 18 can be activated to move the MGS vessel 10. When the sliding frames 38 are raised holes 41' and 42' are exposed and the sliding frames 38 are pinned through hole 41 and others The present device has been developed to accommodate multiple drilling rigs. If the U-tube cannot be connected to the shaker possum belly on the shaker mud tank, the operator can raise the MGS by removing the safety pins 41, or 42 in support frames 38 to permit the double-acting hydraulic lift arms 18 to move the MGS 10 to a level which allows the U-tube upper arm 16' and its right-elbow 26 to be connected to the possum belly connections. Once the MGS vessel is at an appropriate height, the safety pins are replaced in the appropriate paths 41, or 42 in support frame 38 to secure the assembly. The support post 40 is also capable of sliding up after attachment to lug 45 offering additional support to the lifted MGS vessel 10. At this point, the MGS is available for operation and the HPU 19 can be turned off.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A craneless elevatable MGS vessel and U-tube assembly comprising:

an MGS vessel mounted on a support base frame providing a swivel bed supporting the vessel;

double-acting hydraulic cylinders for raising the vessel from its horizontal shipping position to its final operating position;

a gas vent line extending from the distal end of the MGS vessel; and a U-joint connecting a sump line of the MGS vessel interposed between the sump line and a mud pit line providing a swivel joint at an upper end of the U-joint and a second swivel joint at a lower end of the U-joint, supported by a hydraulic cylinder connecting the upper extension of the U-joint to the adjacent extended U-joint member for moving the U-joint in an independent direction to align the U-joint with a mud handling system of a drilling rig.

2. The craneless elevatable MGS vessel and U-tube assembly of claim 1 wherein the U-joint assembly is affixed by a brace to the MGS vessel for transportation.

3. A method for installation of a craneless elevatable MGS vessel as claimed in claim 1 comprising:

moving a MGS vessel and attached U-tube mud line on a support base frame to a side of the mud handling system of a drilling rig;

raising the MGS vessel and the attached U-tube mud line on its support base frame using double-acting hydraulic cylinders from its transportation horizontal position into a final vertical position;

activating a hydraulic system to move the U-joint mud tube to a mud system flow line;

connecting a choke line to one or more high pressure drilling mud inlet lines; and, connecting a top vent line extending from the top of the MGS vessel to a gas vent line.

4. A craneless elevatable MGS vessel and U-tube assembly comprising:

an MGS vessel mounted on a support base frame providing a swivel bed supporting the vessel providing a gas vent line extending from the distal end of the MGS vessel; and a U-joint connecting a sump line of the MGS vessel interposed between the sump line and a mud pit line providing a swivel joint at an upper end of the U-joint and a second swivel joint at a lower end of the U-joint, supported by a hydraulic cylinder connecting the upper extension of the U-joint to the adjacent extended U-joint member for moving the U-joint in an independent direction to align the U-joint with a mud handling system of a drilling rig;

double-acting hydraulic lifting means for raising the vessel from its shipping position to its final operating position; and, a plurality of lifting lugs attached to MGS vessel in spaced relationship for attachment of the double-acting hydraulic lifting means at selectable positions along the MGS vessel permitting the operator to raise the MGS vessel to an appropriate height.

* * * * *